US006467199B1

(12) United States Patent
Christy

(10) Patent No.: US 6,467,199 B1
(45) Date of Patent: Oct. 22, 2002

(54) HAND-CONTROL FOR V-PLOWS

(75) Inventor: Jody Christy, Iron Mountain, MI (US)

(73) Assignee: M. J. Electric, Inc., Iron Mountain, MI (US)

( * ) Notice: Subject to any disclaimer, the term of this patent is extended or adjusted under 35 U.S.C. 154(b) by 0 days.

(21) Appl. No.: 09/628,335

(22) Filed: Jul. 28, 2000

Related U.S. Application Data

(60) Provisional application No. 60/146,132, filed on Jul. 30, 1999.

(51) Int. Cl.[7] ..... E01H 5/04
(52) U.S. Cl. ..... 37/234; 37/273
(58) Field of Search ..... 37/234, 272, 273, 37/283; 341/22, 20, 34; 200/6 A

(56) References Cited

U.S. PATENT DOCUMENTS

| | | | | |
|---|---|---|---|---|
| 1,878,080 A | | 9/1932 | Weeks | |
| 1,929,799 A | | 10/1933 | Weeks | 37/145 |
| 1,997,001 A | | 4/1935 | Lamb | 37/144 |
| 2,242,472 A | | 5/1941 | Keeler | 37/42 |
| 3,273,730 A | | 9/1966 | Moore | 214/146 |
| 3,677,604 A | | 7/1972 | Leyrat | 299/67 |
| 3,706,144 A | | 12/1972 | Miceli | 37/42 |
| 3,793,752 A | | 2/1974 | Snyder | 37/42 R |
| 4,012,175 A | | 3/1977 | Simonds, Jr. | 417/316 |
| 4,028,820 A | | 6/1977 | Simonds, Jr. | 37/41 |
| 4,074,448 A | | 2/1978 | Niemela | 37/41 |
| 4,941,275 A | | 7/1990 | Beeley et al. | 37/219 |
| 4,999,935 A | | 3/1991 | Simi et al. | 37/236 |
| RE33,835 E | | 3/1992 | Kime et al. | 239/657 |
| 5,177,887 A | | 1/1993 | McGugan et al. | 37/236 |
| 5,255,188 A | * | 10/1993 | Telepko | |
| 5,265,356 A | | 11/1993 | Winter | 37/234 |
| 5,285,588 A | | 2/1994 | Niemela et al. | 37/234 |
| 5,361,519 A | | 11/1994 | Ciula et al. | 37/234 |
| 5,638,618 A | | 6/1997 | Niemela et al. | 37/281 |
| 5,805,074 A | * | 9/1998 | Warren et al. | |
| 6,138,388 A | * | 10/2000 | Kost et al. | |
| 6,163,985 A | * | 12/2000 | Chinnery et al. | |
| 6,181,992 B1 | * | 1/2001 | Gurne et al. | |

OTHER PUBLICATIONS

US 6,000,150, 12/1999, Depies et al. (withdrawn)

* cited by examiner

*Primary Examiner*—Victor Batson
(74) *Attorney, Agent, or Firm*—Jim Zegeer

(57) ABSTRACT

A hand-held control device for a V-blade plow in which left and right plow blade wings are pivotally mounted on a vertical pivot on a vehicle mounting frame and actuated about the vertical pivot by electric switch-controlled hydraulic actuators, there being an electric switch to control the extension of a hydraulic actuator, respectively, and an electrical switch for controlling retraction of the hydraulic actuator, respectively. Each electrical switch has an associated thumb actuator, the thumb actuators being in an array so that an operator's thumb or finger can actuate two thumb actuators simultaneously while gripping the hand-held control device with the same hand. The plow includes a third hydraulic actuator for raising and lowering the frame relative to ground and an electric switch pair for controlling extension and retraction, respectively, of the third hydraulic actuator. There are first, second, third, fourth and fifth thumb actuators and their associated first, second, third, fourth, fifth and sixth electrical switches in the array and the common actuator. Actuation of the switches result in wing positionings according to the following schedule: extend right wing, actuate first switch; retract right wing, actuate second switch; extend left wing, actuate third switch; retract left wing, actuate fourth switch; angle right, actuate first and second switches; angle left, actuate third and fourth switches; scoop, actuate first and third switches; VEE, actuate fourth and second switches; raise, actuate fifth switch; and lower, actuate sixth switch.

8 Claims, 9 Drawing Sheets

HAND-CONTROL FOR V-PLOWS

REFERENCE TO RELATED APPLICATIONS

This application is the subject of provisional application Ser. No. 60/146,132 filed Jul. 30, 1999 and entitled V-SNOWPLOW HAND-HELD CONTROL.

BACKGROUND AND BRIEF DESCRIPTION OF THE INVENTION

Hand-held controls have been provided in the past for controlling V-blade snow plow blades in the various configurations including, for example, the Vee condition, Scoop condition, Raise and Lower conditions, etc. Such prior art hand-held controls have been complicated and time-consuming and confusing to the user.

The object of the present invention is to provide an improved hand-held control for V-blade snowplows which is less complicated, more easily used and more ergonomically compliant.

According to the invention, a key pad of a V-blade hand-held control is laid out so that the operator's thumb can press and activate two wing buttons simultaneously to achieve a combination of the individual button functions. Furthermore, this can be done by holding the hand-control with the same hand. For example, the extend Right Wing and extend Left Wing are located right next to each other so that both can be pressed simultaneously with the thumb or one finger. The resulting function, Scoop, moves both blade wings out. As a further example, the extend Right Wing and retract Right Wing are also located immediately next to each other so that both can be pressed simultaneously with the thumb or one finger, and the resulting function, Angle Right, extends the Left Wing and retracts the Right Wing. The control buttons are illuminated function indicia so that it is easy to use, even at night.

Thus, the invention provides hand-held control device for a V-blade plow in which left and right plow blade wings are pivotally mounted on a vertical pivot on a vehicle mounting frame and actuated about the vertical pivot by electric switch-controlled hydraulic actuators, there being an electric switch to control the extension of a hydraulic actuator, respectively, and an electrical switch for controlling retraction of the hydraulic actuator, respectively. Each electrical switch has an associated thumb actuator, the thumb actuators being in an array so that an operator's thumb or finger can actuate two thumb actuators simultaneously while gripping the hand-held control device with the same hand. The plow includes a third hydraulic actuator for raising and lowering the frame relative to ground and an electric switch pair for controlling extension and retraction, respectively, of the third hydraulic actuator. There are first, second, third, fourth and fifth thumb actuators and their associated first, second, third, fourth, fifth and sixth electrical switches in the array and the common actuator. Actuation of the switches result in wing positionings according to the following schedule:

| V-Blade Function | Switch Actuation |
|---|---|
| Extend Right Wing | First Switch |
| Retract Right Wing | Second Switch |
| Extend Left Wing | Third Switch |
| Retract Left Wing | Fourth Switch |
| Angle Right | First and Second Switches |

-continued

| | |
|---|---|
| Angle Left | Third and Fourth Switches |
| Scoop | First and Third Switches |
| VEE | Fourth and Second Switches |
| Raise | Fifth Switch |
| Lower | Sixth Switch |

DESCRIPTION OF THE DRAWINGS

The above and other objects, advantages and features of the invention will become more apparent when considered in conjunction with the following specification and accompanying drawings wherein.

DETAILED DESCRIPTION OF THE INVENTION

The invention is particularly applicable to V-blade snowplows but may be applied to other V-blade plows as well. Reference is made to my copending application Ser. No. 09/320,669 for a detailed exposition of the plow blade components and the vehicle mounting mechanism and the general operation thereof. The present invention is particularly concerned with the hand-held controller and the juxtapositioning of the thumb actuated switches relative to each other.

Figure 1:
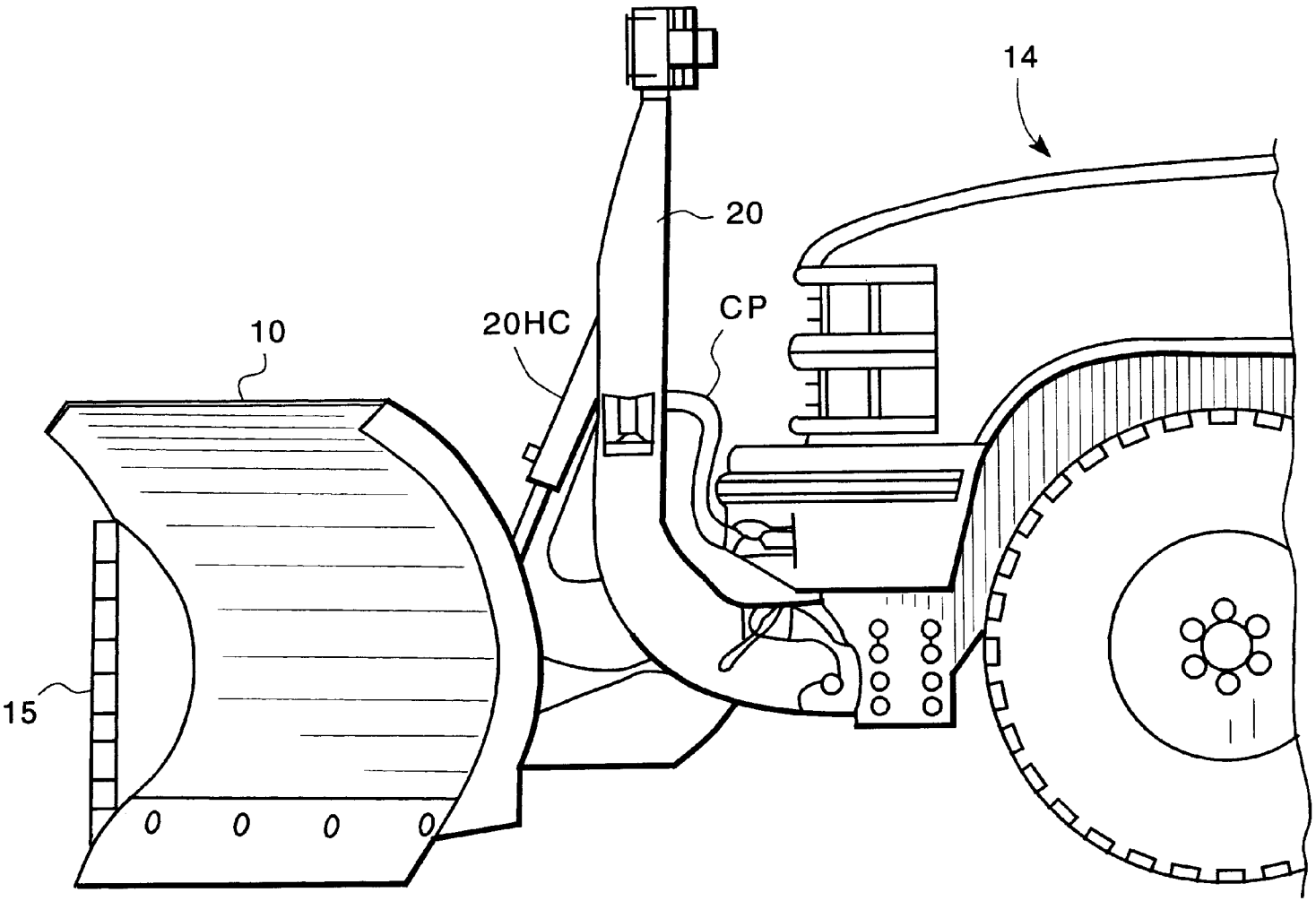
FIG. 1 is a side elevational view of a vehicle with a plow attached and operable in accordance with the present invention attached.
Figure 2:
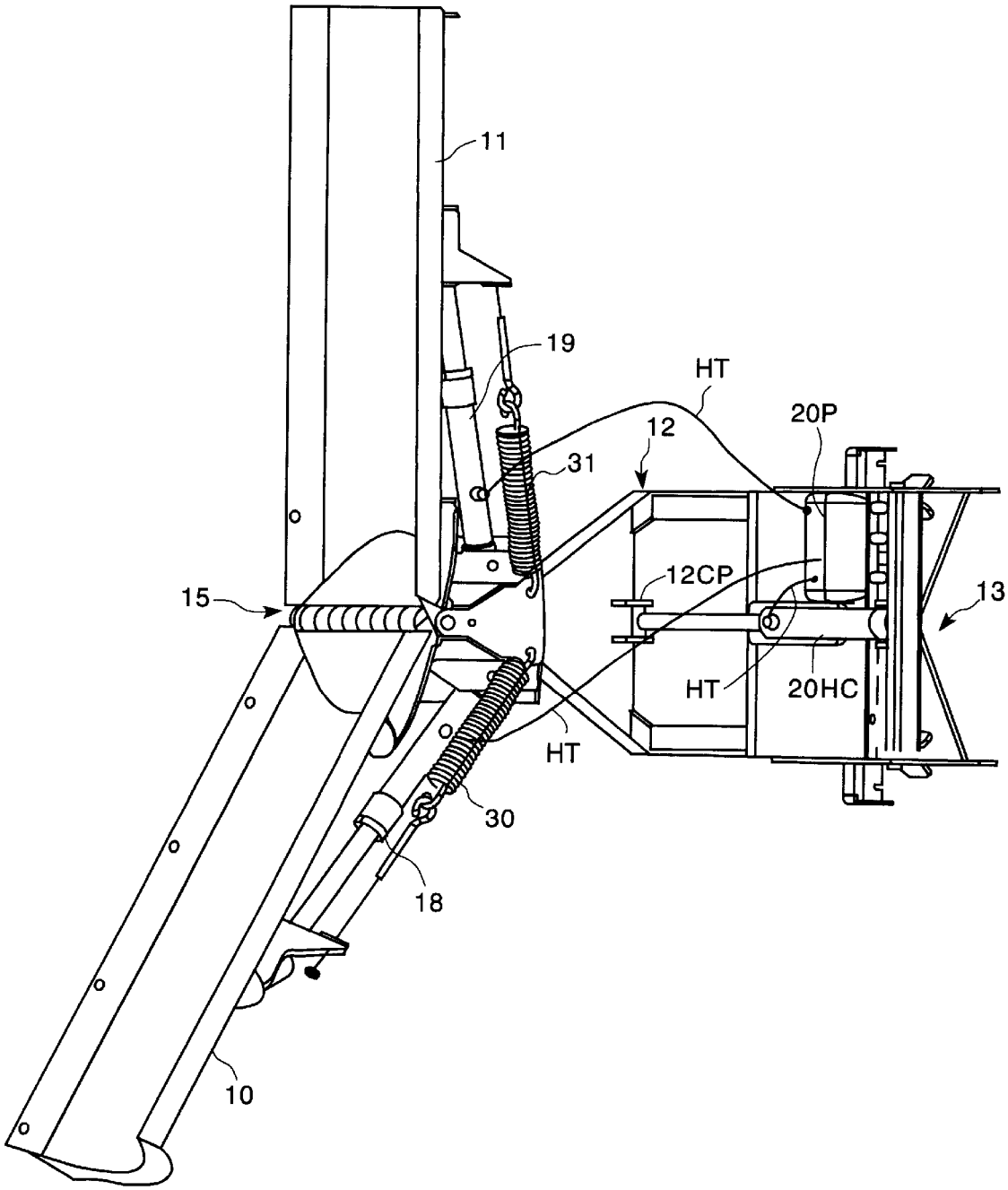
FIG. 2 is a top plan view of a V-plow and plow attachment mounting frame detached from the vehicle showing the hydraulic actuators and their return spring for each wing blade and the hydraulic actuator for a lift or raise mechanism.
Figure 3:
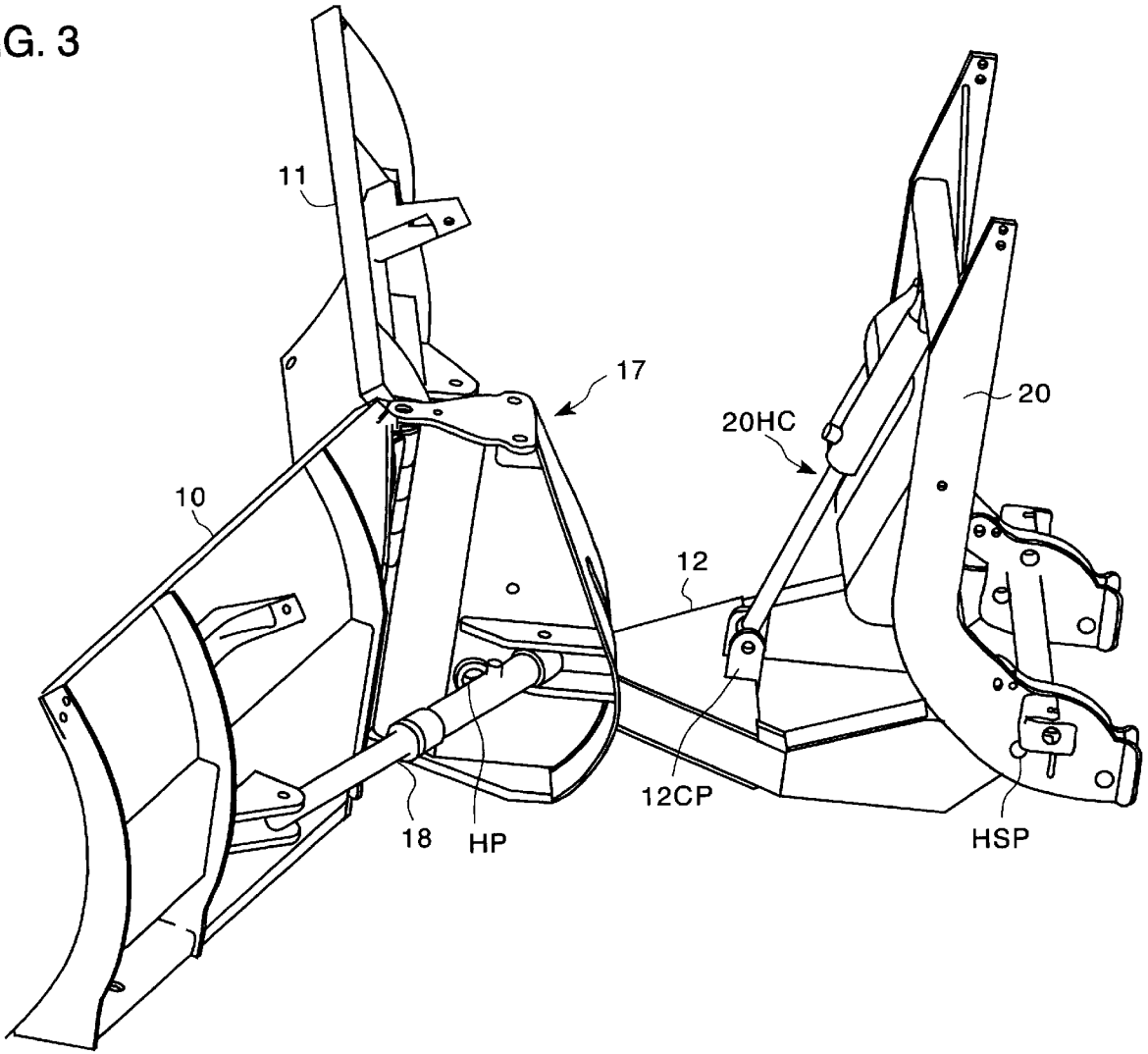
FIG. 3 is an isometric perspective view of the V-plow and attachment mounting frame.

Referring now to FIGS. 1, 2 and 3, left and right blade wings 10 and 11 are carried on a mounting frame 12 which has an attachment mechanism 13 for attaching to the front end of a vehicle such as a pickup truck 14. Details of the mounting mechanism and the attachment to the pickup truck 14 are described in detail in the aforementioned patent application Ser. No. 09/320,669. The snowplow blade wings 10 and 11 are mounted on a central vertical pivot 15 and are articulated or actuated into various positions for plowing by left and right hydraulic actuators or cylinders 18 and 19, respectively. The actuators are pivotally connected to cowling 17 on the blades and are pivotally connected to the plow mounting frame 12. As more fully described in the aforementioned pending application, the blades are mounted or carried on a cowling 17 which is pivotally mounted on a horizontal pivot HP on the forward end of the mounting frame 12. A set of springs (not shown) extending between the lift/light tower 20 and cowling 17 maintains the blades in the upright and provides for full blade trip for speed bumps and the like during plowing operations.

Figure 6:
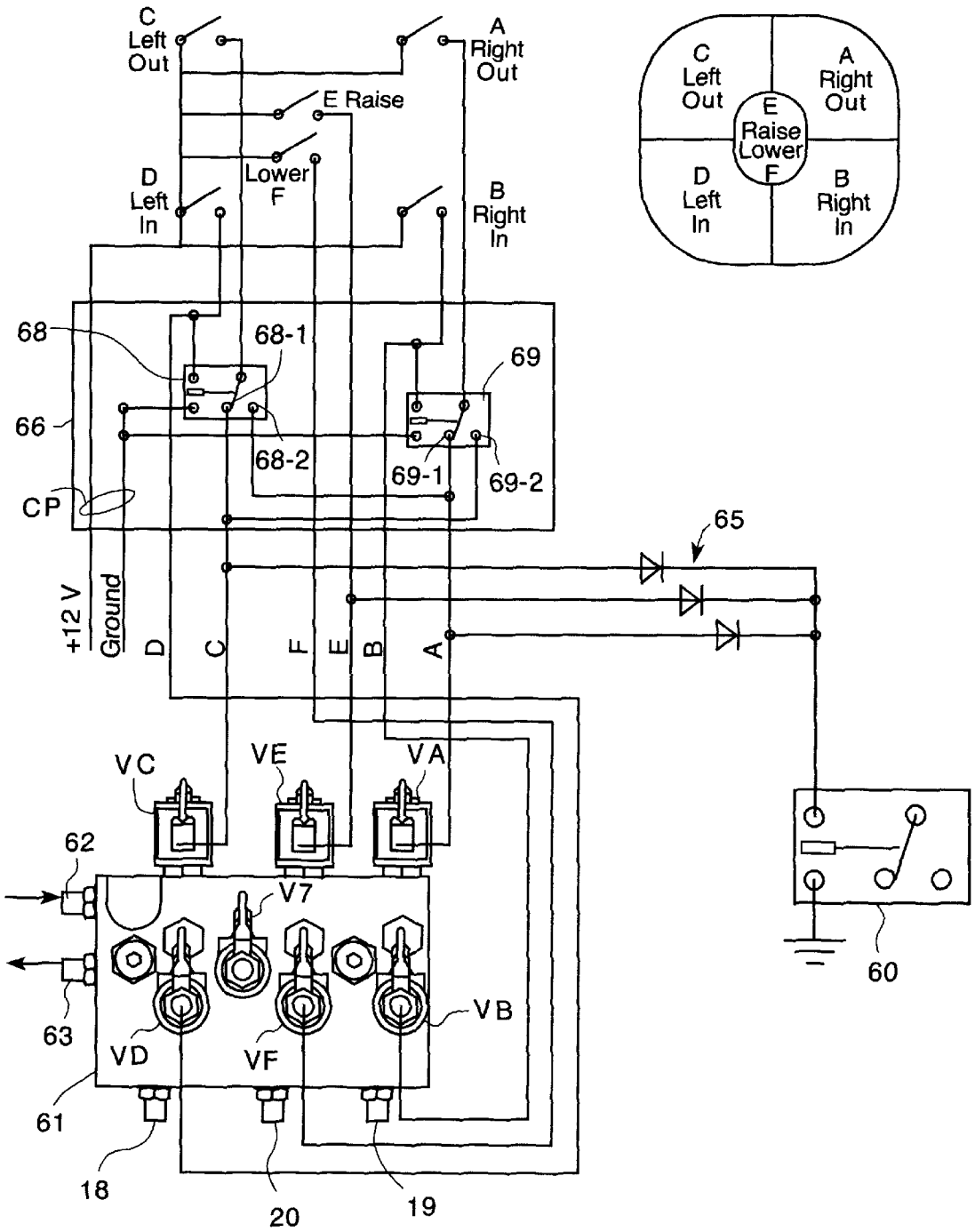
FIG. 6 is a schematic and hydraulic diagram illustrating the control circuit.
Figure 7A:
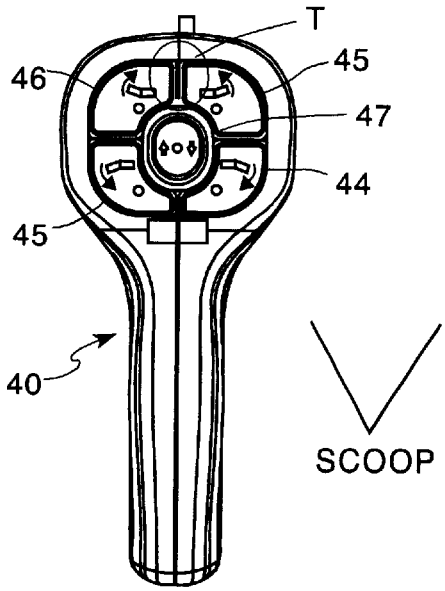
FIGS. 7A–7H are diagrammatic illustrations of a schedule of functions performed by the pushbuttons and pushbutton combinations in the control handle.
Figure 7B:
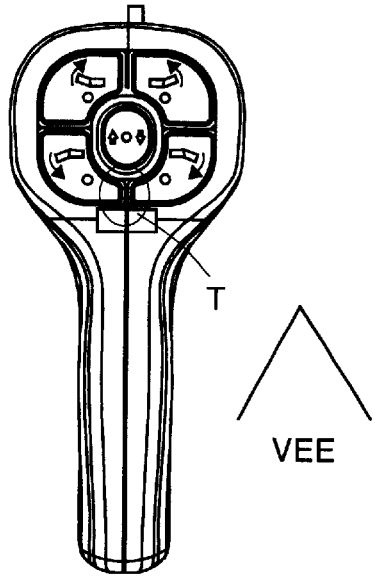
Figure 7C:
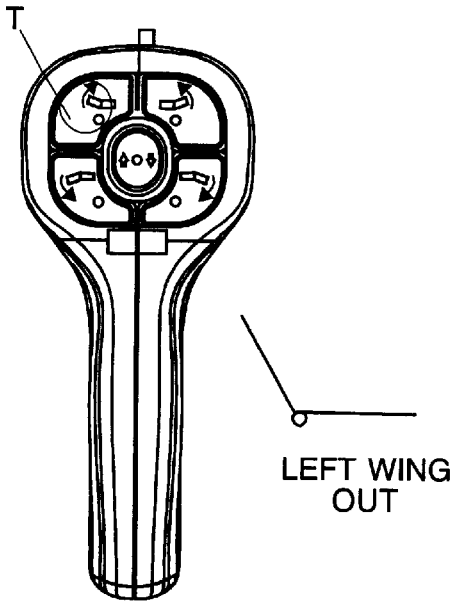
Figure 7D:
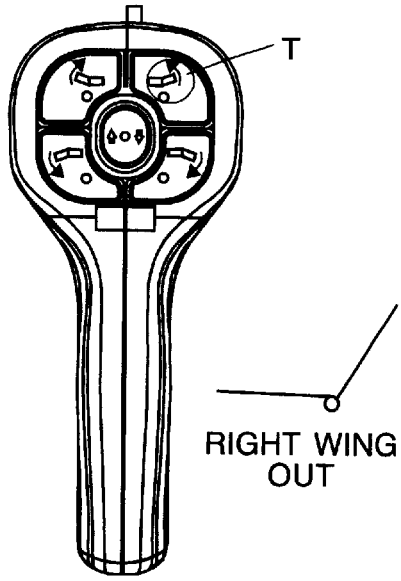
Figure 7E:
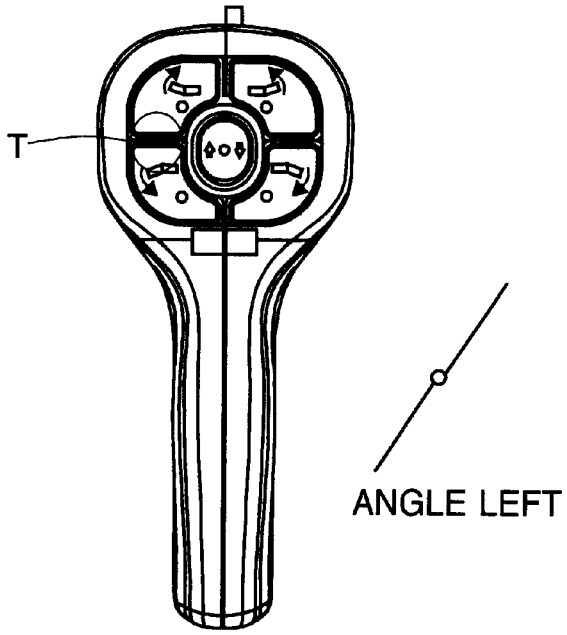
Figure 7F:
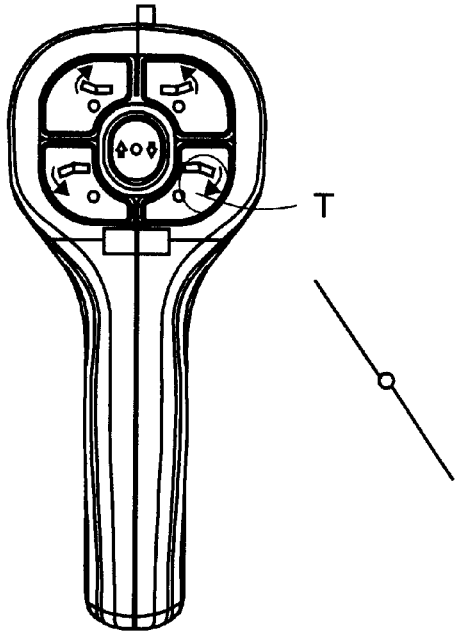
Figure 7G:
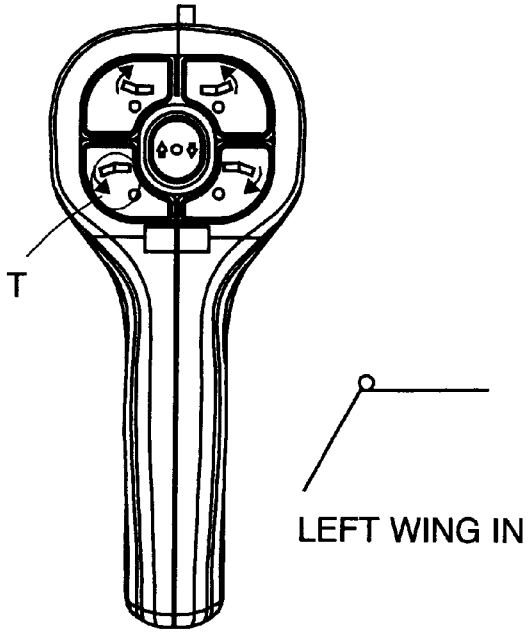
Figure 7H:
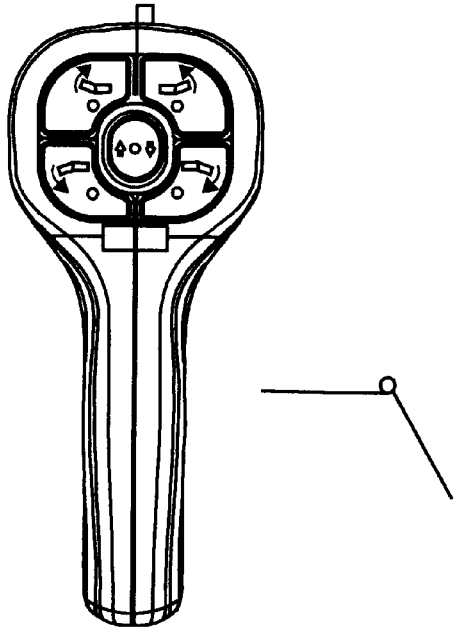

In general, the snowplow frame has a subframe and a vertically extending lift/light tower 20 pivotally connected at its lower end by a horizontal pivot HSP to the trailing end of the mounting subframe. A single-acting hydraulic actuator or cylinder 20HC is pivotally connected at its respective ends to the upper end of the vertically extending lift/light tower 20 and to a clevis point 12CP on the subframe spaced forwardly of the horizontal pivot. A hydraulic pump 20P on the vertical extending lift/light tower 20 provides lifting force to the entire assembly. The hydraulic valve manifold 61 shown in FIG. 6 is carried on the lift/light tower 20 and hydraulic tubing HT operatively connects the actuators to the valve manifold 61. Reference to made to Capra et al U.S. Pat. No. 5,568,694 (incorporated herein by reference) for a more full explanation of the plow details and the functioning thereof.

In the embodiment shown in FIGS. 1, 2 and 3, the hydraulic cylinders/actuators 18, 19 are single-acting and return force is applied by Left Wing springs 30 and Right Wing springs 31, respectively, which are connected between the respective blades and cowling assembly 17. In the embodiment shown in FIG. 8, double-acting hydraulic cylinders are utilized in which case the springs 30 and 31 are not utilized.

THE PRESENT INVENTION

Figure 4:
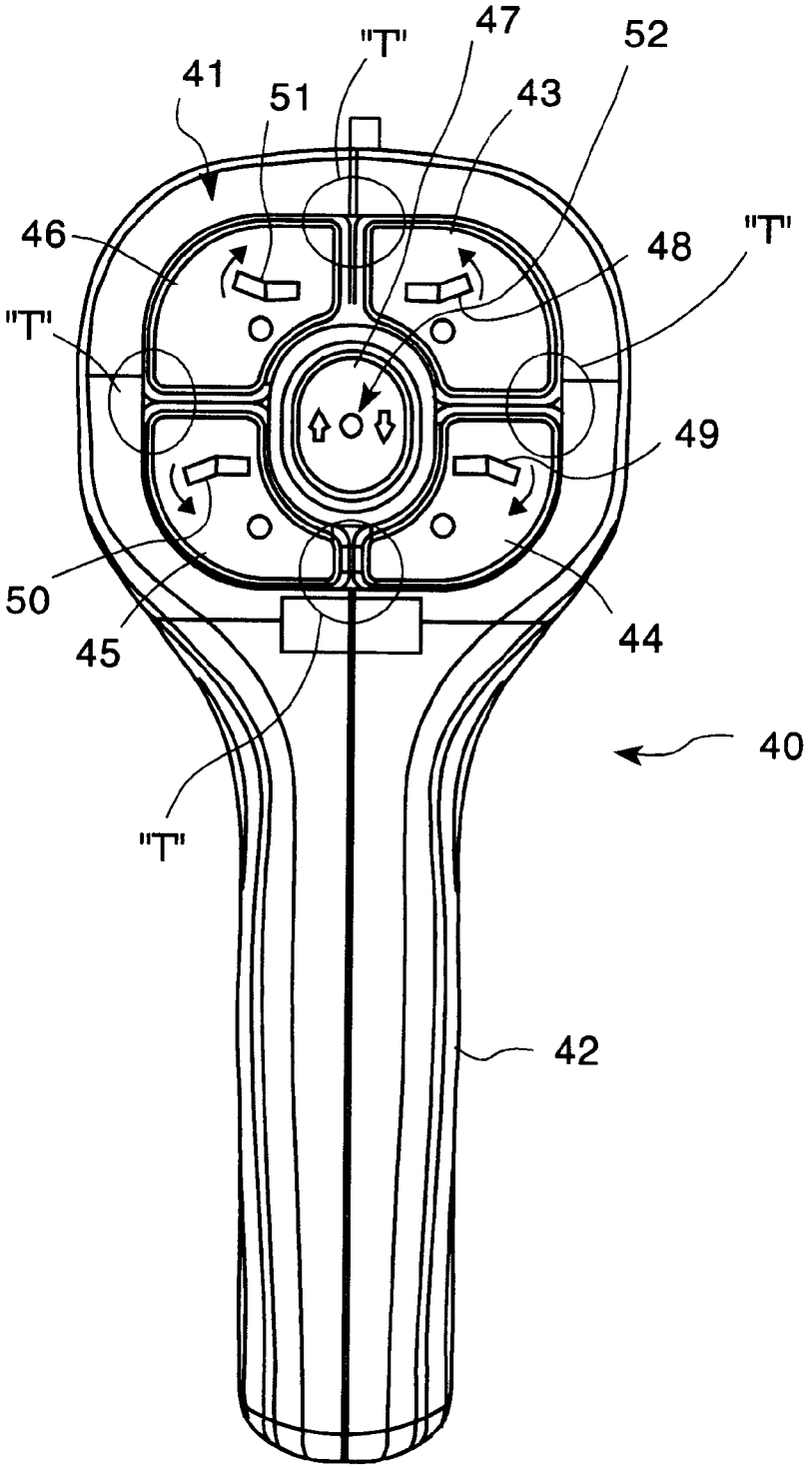
FIG. 4 is an illustration of the control handle showing the pushbutton switch array.
Figure 5:
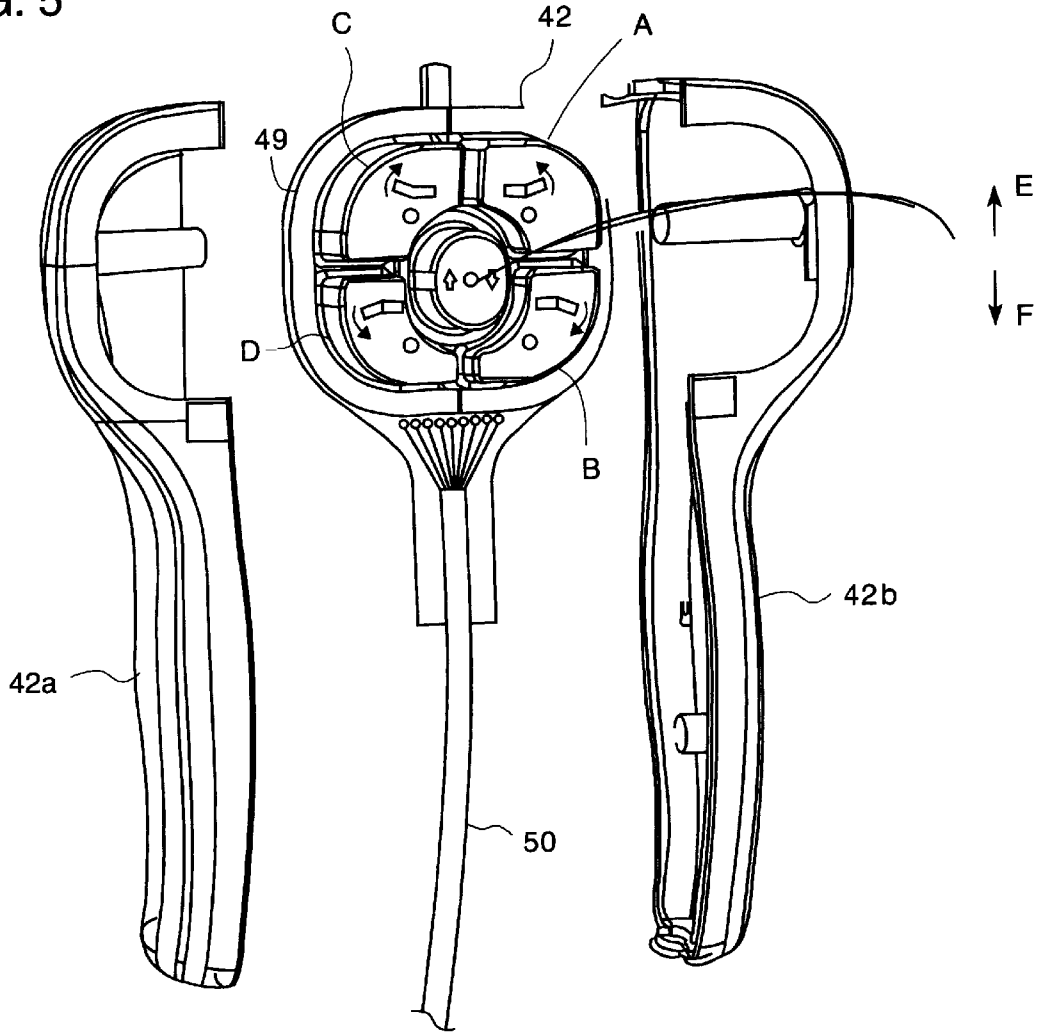
FIG. 5 is an illustration of the hand-held controller showing the two halves of the housing and exposing some of the switching and more clearly showing the indicia on the pushbuttons indicating the function to be performed.

The present invention is directed to the arrangement of the hand-held control 40, best seen in FIGS. 4 and 5 and preferably carried or stored in the cab of the vehicle. Referring now to FIGS. 4 and 5, the hand-held control 40 includes a key pad 41 which is comprised of a handle 42 having a key pad 41 which contains an array of actuator buttons 43, 44, 45, 46 and 47 which have associated therewith switches A, B, C and D (see FIG. 6), each actuator having an indicia 48, 49, 50, 51 and 52 which have configurations or shapes to indicate the function to be performed. For example, thumb actuator 43 has indicia or an icon which indicates the Right Wing out and has an arrow indicating that the Right Wing blade is going in the out direction. Similarly, thumb actuator 46 controls the Left Wing out and has an indicia S1 which so indicates. While each actuator 43–46 has a single switch associated therewith (see FIG. 6), actuator 47 is a toggle switch with two switches associated therewith. Thus, the central switch actuator 47 has two switches E and F (FIG. 6) associated therewith, one of which is to activate actuator 20HC to raise the plow assembly, and the other is to lower the plow assembly. The thumb actuators 43–47 are laid out so that the operator's thumb or finger can press and activate two wing buttons or thumb actuators simultaneously and achieve a combination of the individual functions. Further, this can be done by holding the control with one hand.

For example, the extend Right Wing and extend Left Wing buttons, thumb controls, actuators 43 and 46 are located right next to each other so that both can be pressed simultaneously with the thumb. The resulting function, Scoop, moves both wing blades 10 and 11 out. The Retract Wing are also located immediately next to each other so that both can be pressed simultaneously with the thumb. The resulting action, Angle Right, extends the Left Wing and retracts the Right Wing. Similarly, the Right Wing end, Left Wing end buttons 44, 45 are located immediately next to each other so that both can be pressed simultaneously with the thumb resulting in a Vee-configuration. The different combinations are illustrated diagrammatically in FIGS. 7A–7H with the thumb T shown in a position to accomplish the given function.

The hand-held control 40 is comprised of a two-part and plastic molded housing 42*a*, 42*b* having a circuit board 49 upon which are mounted the pushbuttons and switch array 42. Housing halves 42*a*, 42*b* are snapped together and bonded with the circuit board 49 mounted thereon.

The circuit diagram for the switch array is shown in FIG. 6. However, cable 50 (FIG. 5) connects its circuits to the hydraulic pump and hydraulic valve manifold mounted in the lift tower 20. In FIG. 6, the switches are designated A, B, C, D, E and F corresponding to first switch, second switch, third switch, fourth switch, fifth switch, sixth switch and the individual function to be performed by each switch is designated by "Right Out", "Right In", "Left In", "Left Out", "Raise" and "Lower", respectively. Twelve volt power is supplied to one terminal of each switch via a 12 volt cable and plug (CP in FIG. 1). The hydraulic manifold 61 is provided with a hydraulic supply 62 at pump pressure and a pump return 63 (the pump not being shown). In this embodiment, since the actuating cylinders 18, 19 and 20 for the Left Wing, Right Wing and lift cylinders are single-acting, only one output/return line for hydraulic fluid is shown to the cylinders, there being an output/return lines 64, 65 and 66 to the Left Wing cylinder 18, lift cylinder 20 and Right Wing cylinder 19, respectively. For the double-acting embodiment shown in FIG. 8, there would be two hydraulic lines to each cylinder. For the purpose of the present invention, there are six solenoid valves mounted on the valve manifold 61 which pertain to this invention. A seventh V7 is shown which is for a function which is not related to the present invention. They are VA, VB, VC, VD, VE, VF, all which have a corresponding lead line thereto designated by the common letters, A, B, C, D, E and F, respectively. When any one of switches A, C or E are actuated, power is supplied via diode array 65 to the pump start solenoid 60 which starts the pump motor and supplies hydraulic fluid under pump pressure to input pressure port 62 on the valve manifold 61 and at the same time actuates at least one of solenoid valves VA, VC and VE. Since the actuators are single-acting hydraulic cylinders, in the case of cylinders 18 and 19, the force of springs 30, 31 causes retraction and forces hydraulic fluid to return via the associated solenoid valve and valve manifold 62 to the pump or sump. The weight of the blade and mounting frame causes return retraction and return of fluid from lift cylinder 20.

A logic circuit 66 provides control functions to the solenoid valves when two of the adjacent switches A, B, C and D are depressed simultaneously. Although the actual circuit utilizes integrated circuits for performing the logic functions, for simplicity and ease of understanding, the circuit is drawn with two relays 68, 69 to illustrate these logic functions. Thus, relay 68 has a set of contacts 68-1, 68-2 which, when in the relay switch position 68-1, the relay C switch function is coupled directly to a C line to a solenoid valve actuator VC to only control the left hydraulic actuator 18 to cause it to move outwardly. When switch 68 is in position 2 and contact is made switch contact 68-2, the circuit is from the left switch C through a conductor through the switch and through the jumper to line A to thereby energize solenoid valve VA and thereby cause the Right Wing to swing outwardly and the Left wing to swing inwardly. A similar operation occurs in connection with relay 69 in connection with its contacts 69-1 and 69-2 and simultaneous actuation of switch A and switch C to form a Scoop.

There is an additional solenoid valve V7 shown on valve manifold 61 which is unused and has no bearing on the present invention and is not discussed so as to maintain clarity of the invention.

Figure 8:
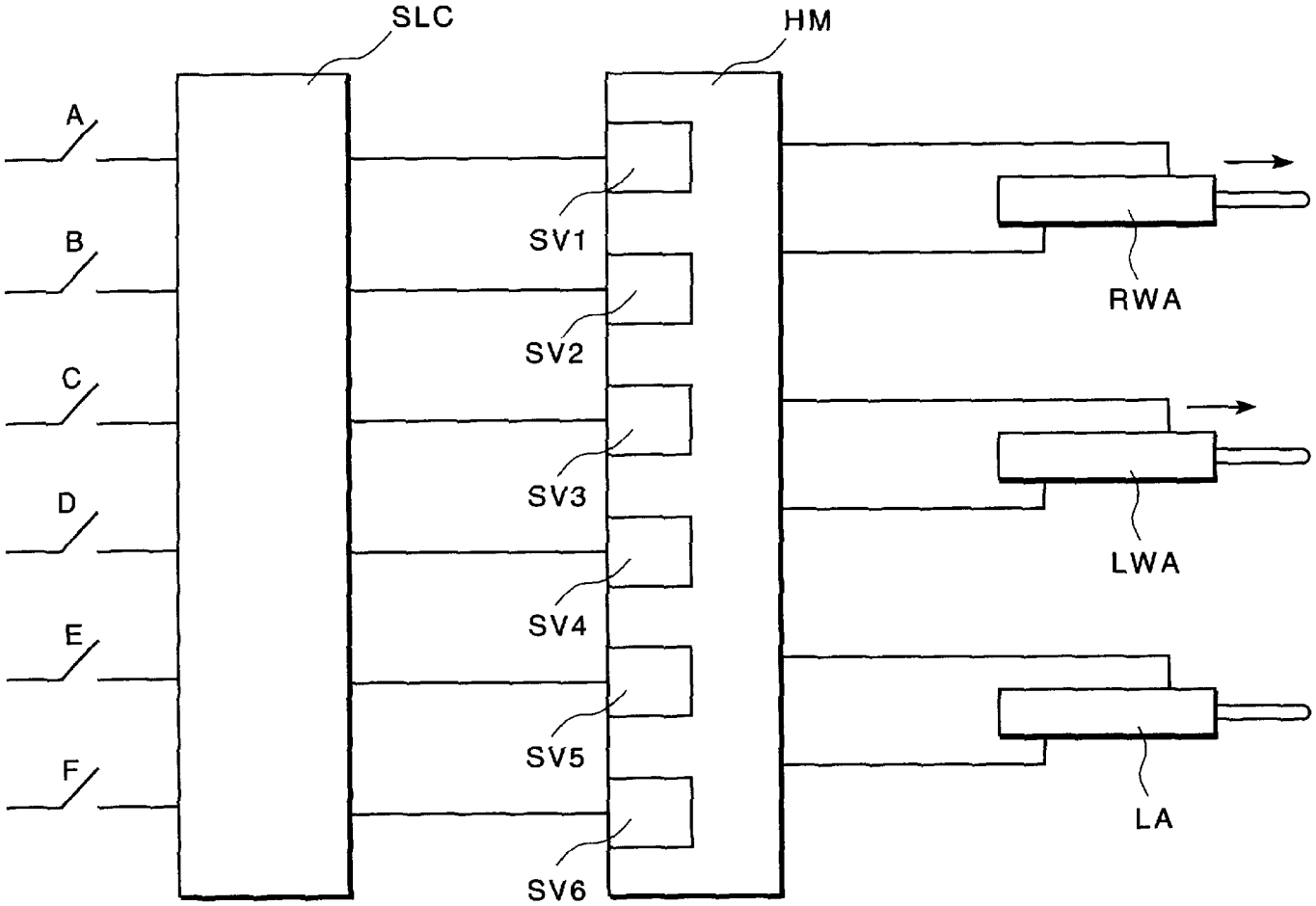
FIG. 8 is a diagrammatic illustration of a circuit of a further embodiment of the invention.

Referring now to FIG. 8, the switches A through F are connected to the switch logic circuit LC which can be the relay shown in FIG. 6 or an integrated circuit to produce the blade functions illustrated in FIGS. 7A–7H.

This switch logic circuit SLC is connected by individual lines to the solenoid valves SV1, SV2, SV3, SV4, SV5 and SV6 which in this case control the flow of hydraulic fluid to both ends of the blade wing actuators RWA, LWA and LA which, in this case, are double-acting cylinders.

The hydraulic manifold HM has individual lines going to the hydraulic cylinders for extension and extraction purposes. In this case, the springs 30, 31 are not needed and may be eliminated. In order to raise and lower the plow, the Raise switch and the Lower switch may be individually actuated or toggled by the user's thumb.

Thus, there has been provided a hand-held control device for V-blade plows, particularly snow plows, in which the left and right plow blade wings are pivotally mounted on a vertical pivot on a vehicle mounting frame and the blade wings actuated about the vertical pivot by electric switch control hydraulic actuators. There is an electric switch to control the extension of each hydraulic actuator and electrical switch for controlling the retraction of the hydraulic actuator. The invention lies in the electrical switch array having an associated thumb or finger actuator with the thumb or finger actuators being in an array so that the operator's thumb or finger can actuate two of the thumb actuators and electrical switches simultaneously while gripping the hand-held control device for the same hand and a logic circuit converts the switch actuations to control signals for solenoid valves on a hydraulic manifold.

While preferred embodiments of the invention have been disclosed and described, it will be appreciated that other embodiments, adaptations and changes to the invention will be readily apparent to those skilled in the art.

What is claimed is:

1. In a hand-held control device for a V-blade for snow plow in which left and right plow blade wings are pivotally mounted on a vertical pivot on a vehicle mounting frame and actuated about said vertical pivot by an electric switch controlled hydraulic actuators, an electric switch to control the extension of a hydraulic actuator, respectively, and an electric switch for controlling retraction of the hydraulic actuator, respectively, the improvement comprising:

each said electric switch having an associated thumb actuator, said thumb actuators being in an array so that an operator's thumb can actuate two of said thumb actuators and electric switches simultaneously while gripping said hand-held control device with the same hand and achieve various combinations of extension and retraction of said hydraulic actuators to place said plow blade wings in a configuration selected from at least V and Scoop.

2. The hand-held control device defined in claim 1 wherein each said thumb actuator has translucent indicia and an illuminator for illuminating said indicia.

3. In a hand-held control device for a V-blade for snow plow in which left and right plow blade wings are pivotally mounted on a vertical pivot on a vehicle mounting frame and actuated about said vertical pivot by an electric switch controlled hydraulic actuators, an electric switch to control the extension of a hydraulic actuator, respectively, and an electric switch for controlling retraction of the hydraulic actuator, respectively, the improvement comprising:

each said electric switch having an associated thumb actuator, said thumb actuators being in an array so that an operator's thumb can actuate two of said thumb actuators and electric switches simultaneously while gripping said hand-held control device with the same hand and achieve various combinations of extension and retraction of said hydraulic actuators to place said plow blade wings in a configuration selected from at least V and Scoop, and wherein said snow plow includes a third hydraulic actuator for raising and lowering said frame relative to ground and an electric switch pair for controlling extension and retraction, respectively, of said third hydraulic actuator, the further improvement comprising said electric switch pair has a common actuator located centrally in said array.

4. The hand-held control device defined in claim 3 wherein there are first, second, third and fourth and said common actuator thumb actuators and their associated first, second, third, fourth, fifth and sixth electric switches in said array, and actuation of said switches resulting in blade wing positionings according to the following schedule: extend right wing, actuate first switch; retract right wing, actuate second switch; extend left wing, actuate third switch; retract left wing, actuate fourth switch; angle right, actuate first and second switches; angle left, actuate third and fourth switches; scoop, actuate first and third switches; VEE, actuate fourth and second switches; raise, actuate fifth switch; and lower, actuate sixth switch.

5. In a hand-held control device for a V-blade plow in which a pair of plow blade wings are pivotally mounted on a vertical pivot on a vehicle mounting frame and independently actuated about said vertical pivot by an electric switch controlled hydraulic actuators, there being an electric switch to control the extension of each hydraulic actuator, respectively, and an electric switch for controlling retraction of the hydraulic actuator, respectively, the improvement comprising:

each said electric switch having a thumb actuator, said thumb actuators being in an array so that an operator's thumb can actuate two of said electrical switches simultaneously while gripping said hand-held control device with the same hand and produce various combinations of extension and retraction of said hydraulic actuators to place said plow blade wings in a configuration selected from at least V and Scoop configurations.

6. The device defined in claim 5 wherein each said thumb actuator has translucent indicia and an illuminator for illuminating said indicia.

7. In a hand-held control device for a V-blade for snow plow in which left and right plow blade wings are pivotally mounted on a vertical pivot on a vehicle mounting frame and actuated about said vertical pivot by an electric switch controlled hydraulic actuators, an electric switch to control the extension of a hydraulic actuator, respectively, and an electric switch for controlling retraction of the hydraulic actuator, respectively, the improvement comprising:

each said electric switch having an associated thumb actuator, said thumb actuators being in an array so that an operator's thumb can actuate two of said thumb actuators and electric switches simultaneously while gripping said hand-held control device with the same hand and achieve various combinations of extension and retraction of said hydraulic actuators to place said plow blade wings in a configuration selected from at least V and Scoop, and wherein there are first, second, third and fourth thumb actuators and their associated electric switches in said array, said switch actuations resulting in blade wing positionings according to the following schedule: angle right, actuate first and second thumb actuators; angle left, actuate third and fourth thumb actuators; scoop, actuate first and third thumb actuators; and VEE, actuate fourth and second thumb actuators.

8. In a hand-held control device for a V-blade plow in which a pair of plow blade wings are pivotally mounted on a vertical pivot on a vehicle mounting frame and independently actuated about said vertical pivot by an electric switch controlled hydraulic actuators, there being an electric switch to control the extension of each hydraulic actuator, respectively, and an electric switch for controlling retraction of the hydraulic actuator, respectively, the improvement comprising:

each said electric switch having a thumb actuator, said thumb actuators being in an array so that an operator's thumb can actuate two of said electrical switches simultaneously while gripping said hand-held control device with the same hand and produce various combinations of extension and retraction of said hydraulic actuators to place said plow blade wings in a configuration selected from at least V and Scoop configurations, and wherein said snow plow includes a third hydraulic actuator for raising and lowering said frame relative to ground and an electric switch pair for controlling extension and retraction, respectively, of said third hydraulic actuator, the further improvement comprising said electrical switch pair has a common actuator located centrally in said array.

* * * * *